US010704488B2

(12) United States Patent
Marchi

(10) Patent No.: US 10,704,488 B2
(45) Date of Patent: Jul. 7, 2020

(54) METHOD AND DEVICE FOR CONTROLLING AN INJECTOR

(71) Applicant: Continental Automotive GmbH, Hannover (DE)

(72) Inventor: Luigi Marchi, Pisa (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 14/900,276

(22) PCT Filed: Jun. 6, 2014

(86) PCT No.: PCT/EP2014/061790
§ 371 (c)(1),
(2) Date: Dec. 21, 2015

(87) PCT Pub. No.: WO2014/202406
PCT Pub. Date: Dec. 24, 2014

(65) Prior Publication Data

US 2016/0369731 A1 Dec. 22, 2016

(30) Foreign Application Priority Data

Jun. 21, 2013 (EP) ..... 13173191

(51) Int. Cl.
*F02D 41/24* (2006.01)
*F02D 41/20* (2006.01)
*F02M 61/10* (2006.01)

(52) U.S. Cl.
CPC ..... *F02D 41/2435* (2013.01); *F02D 41/20* (2013.01); *F02D 41/247* (2013.01);
(Continued)

(58) Field of Classification Search
CPC .. F02D 41/2435; F02D 41/2467; F02D 41/20; F02D 41/247; F02D 2041/2055;
(Continued)

(56) References Cited

U.S. PATENT DOCUMENTS 5,575,264 A * 11/1996 Barron ..... F02D 41/2435 123/472
5,577,663 A * 11/1996 Nally ..... F02M 51/0664 239/1
(Continued)

FOREIGN PATENT DOCUMENTS

CN 1404550 A 3/2003 ..... F02M 45/08
CN 101052797 A 10/2007 ..... F02D 41/24
(Continued)

OTHER PUBLICATIONS

European Search Report, Application No. 13173191.1, 6 pages, dated Dec. 16, 2013.
(Continued)

*Primary Examiner* — Joseph J Dallo
*Assistant Examiner* — Scott A Reinbold
(74) *Attorney, Agent, or Firm* — Slayden Grubert Beard PLLC

(57) ABSTRACT

A method is disclosed for controlling an injector of a combustion engine. The injector includes an injection valve housing with an injection valve cavity, a valve needle axially movable within the injection valve cavity, a valve seat on which the valve needle rests in a closed position and from which the valve needle is lifted for an open position, and a spring element configured and arranged to exert a preload force on the valve needle acting to urge the valve needle in the closed position. A calibration value is provided, which is representative for the preload force. A base quantity is provided correlated to the fluid volume to be dispensed by
(Continued)

the injector. A set-point opening time length is determined based on the calibration value and the base quantity. The valve needle of the injector is controlled to be in the opening position correlated to the set-point opening time length.

11 Claims, 3 Drawing Sheets

(52) U.S. Cl.
CPC ..... *F02D 41/2467* (2013.01); *F02M 61/10* (2013.01); *F02D 2041/2055* (2013.01); *F02M 2200/8007* (2013.01); *F02M 2200/8092* (2013.01)

(58) Field of Classification Search
CPC .. F02D 19/024; F02D 2200/063; F02D 41/40; F02D 2041/2051; F02D 41/2432; F02D 41/30; F02D 41/34; F02D 19/027; F02M 61/10; F02M 2200/8007; F02M 2200/8092; F02M 61/205; H01L 41/0536
USPC ..... 123/480
See application file for complete search history.

(56) References Cited

U.S. PATENT DOCUMENTS

| | | | | |
|---|---|---|---|---|
| 5,871,155 | A | 2/1999 | Stockner et al. | 239/92 |
| 7,628,146 | B2 | 12/2009 | Kloppenburg et al. | 123/673 |
| 2002/0179747 | A1* | 12/2002 | Bulgatz | F02M 51/0671 239/585.1 |
| 2003/0130784 | A1* | 7/2003 | Peltier | F02B 61/045 701/104 |
| 2003/0141389 | A1 | 7/2003 | Boecking | 239/585.1 |
| 2010/0145597 | A1* | 6/2010 | Keegan | F02D 41/0085 701/106 |
| 2012/0234298 | A1* | 9/2012 | Jung | F02D 41/2432 123/478 |
| 2013/0152902 | A1* | 6/2013 | Brandt | F02D 41/2432 123/480 |

FOREIGN PATENT DOCUMENTS

| | | | | |
|---|---|---|---|---|
| EP | 1026384 | A1 * | 8/2000 | F02D 41/2435 |
| EP | 1026384 | A1 * | 8/2000 | F02D 41/2435 |
| GB | 2353565 | A | 2/2001 | F02M 45/08 |
| JP | 2001241350 | A | 9/2001 | F02D 41/04 |
| JP | 2012122426 | A | 6/2012 | F02M 47/00 |
| KR | 19990014928 | A | 2/1999 | F02M 51/06 |
| WO | 94/13991 | A1 | 6/1994 | F02D 41/20 |
| WO | 2014/202406 | A1 | 12/2014 | F02D 41/24 |

OTHER PUBLICATIONS

International Search Report and Written Opinion, Application No. PCT/EP2014/061790, 8 pages, dated Sep. 5, 2014.
Chinese Office Action, Application No. 201480035468.2, 12 pages, dated Jul. 10, 2017.
Korean Decision of Refusal, Application No. 2018013804225, 4 pages, dated Feb. 27, 2018.
Korean Decision of Refusal, Application No. 2018013804371, 4 pages, dated Feb. 27, 2018.
Chinese Office Action, Application No. 201480035468.2, 19 pages, dated Aug. 8, 2018.

* cited by examiner

METHOD AND DEVICE FOR CONTROLLING AN INJECTOR

CROSS-REFERENCE TO RELATED APPLICATIONS

This application is a U.S. National Stage Application of International Application No. PCT/EP2014/061790 filed Jun. 6, 2014, which designates the United States of America, and claims priority to EP Application No. 13173191.1 filed Jun. 21, 2013, the contents of which are hereby incorporated by reference in their entirety.

TECHNICAL FIELD

The invention relates to a method and a corresponding device for controlling an injector of a combustion engine.

BACKGROUND

Injectors are in widespread use, in particular for internal combustion engines where they may be arranged in order to dose the fluid into an intake manifold of the internal combustion engine or directly into the combustion chamber of a cylinder of the internal combustion engine.

Because of legal constraints relative to gas emission, it is important to control the injection of the fuel quantity into the combustion chamber of the engine. Hereby, it is important that the dispersion of the injected fuel into the engine chamber is as low as possible.

SUMMARY

One embodiment provides a method for controlling an injector of a combustion engine, wherein the injector comprises an injection valve housing with an injection valve cavity, a valve needle being axially movable with the injection valve cavity, a valve seat, on which the valve needle rests in a closed position and from which the valve needle is lifted for an open position, a spring element being designed and arranged to exert a preload force on the valve needle acting to urge the valve needle in the closed position, an actuator assembly for displacing the valve needle away from the closed position, a calibration value is provided, which is representative for the preload force, a base quantity is provided in dependence of a fluid volume to be dispensed by the injector, dependent on the calibration value and the base quantity, a set-point opening time length is determined, the valve needle of the injector is controlled to be in the open position by means of energizing the actuator assembly with a current signal or a voltage signal having the set-point opening time length.

In a further embodiment, the base quantity is a base opening time length for which the injector would be controlled to be in the open position for dosing fluid without taking into account the calibration value.

In a further embodiment, the set-point opening time length is determined in such a manner, that if the base opening time length is shorter than an adjustment opening time length, for which the injector was adjusted with regards to the preload force, then the set-point opening time length is longer, the higher the preload force is, which is represented by the calibration value.

In a further embodiment, the calibration value is provided by a coding of the injector.

In a further embodiment, the coding is a barcode.

In a further embodiment, the method is configured for controlling a further injector in addition to the injector, wherein the injector and the further injector each comprise an actuator assembly, the method comprising: providing a further calibration value for the further injector which is representative for the preload force of the further injector, determining a further set-point opening time length for the further injector in dependence from the further calibration value and the base quantity, operating the injector by means of energizing its actuator assembly for the set-point time length, and operating the further injector by means of energizing its actuator assembly for the further set-point time length.

Another embodiment provides a device for controlling an injector of a combustion engine, wherein the device is designed to execute any of the methods disclosed above.

BRIEF DESCRIPTION OF THE DRAWINGS

Example embodiments of the invention are explained below with reference to the drawings, in which.

DETAILED DESCRIPTION

Figure 1:
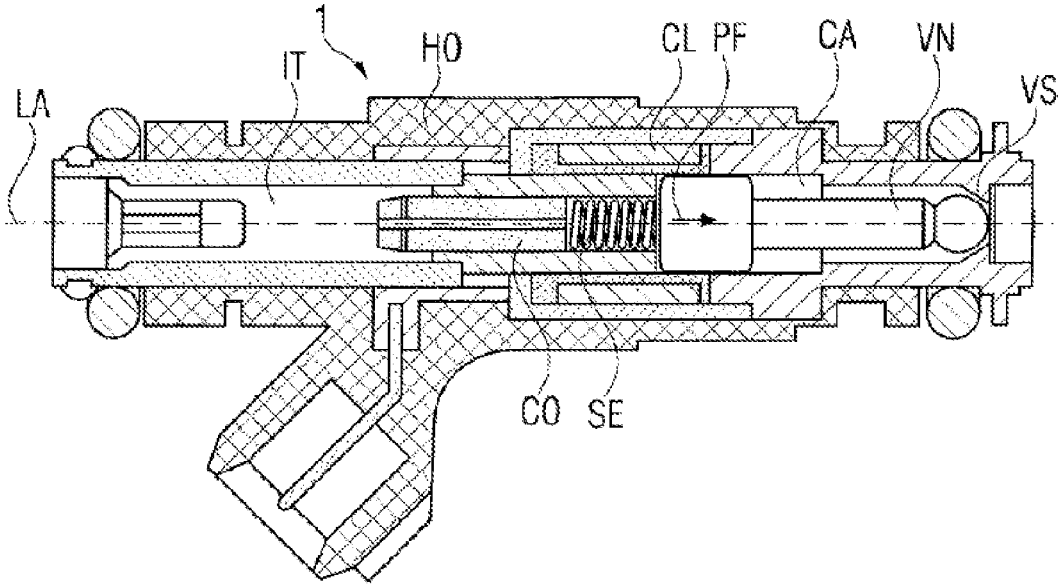
FIG. 1 shows an example injector in a longitudinal section view, according to one embodiment, FIG. 2 a flow chart of a method for controlling the injector, according to one embodiment, FIG. 3 a chart of injection volumes at different opening time lengths of injectors with different preload forces, according to one embodiment, FIG. 4 a chart of the preload force over the injection volume, according to one embodiment, FIG. 5 an exemplary adaption of the opening time length, according to one embodiment, and FIG. 6 the injection volume of the injectors of FIG. 3 with an adapted opening time length.

Embodiments of the invention specify a method and a corresponding device for controlling an injector, with which a very exact injection volume can be achieved.

A method and a corresponding device for controlling an injector of a combustion engine are specified.

The injector may be a fluid injector, e.g., a fuel injector. It may have a central longitudinal axis. It comprises an injection valve housing with an injection valve cavity, a valve needle being received in the injection valve cavity and axially movable with respect to the injection valve housing, a valve seat, on which the valve needle rests in a closed position and from which the valve needle is lifted for an open position. In particular, the valve needle is displaced from the closed position in longitudinal direction away from the valve seat for dispensing fluid from the injector. Preferably, the injector comprises an actuator assembly for displacing the valve needle away from the closed position. The actuator assembly may be a piezoelectric actuator assembly or an electromagnetic actuator assembly.

The injector further comprises a spring element being designed and arranged to exert a preload force on the valve needle acting to urge the valve needle in the closed position. In particular, the spring element is operable to bias the valve needle—in particular a sealing element of the valve needle, the sealing element being configured to contact the valve seat in the closed position and to be spaced apart from the valve seat when the valve needle is displaced away from the closed position—in longitudinal direction towards the valve seat.

A calibration value is provided, which is representative for the preload force. The calibration value is, for example, the value of the preload force. Other calibration values which are representative for the preload force are also conceivable, e.g. an axial position of a spring seat of the spring element.

A base quantity is provided in dependence on a fluid volume to be injected during one injection event (also abbreviated as "injection volume" in the following). In other words, the base quantity is provided to predetermine an injection volume so that different base quantities correspond to different injection volumes.

In one embodiment, the base quantity is the fluid volume. In another embodiment, the base quantity is the mass of the fuel corresponding to the injection volume. In yet another embodiment, the base quantity is a base opening time length correlated to which the valve needle shall be in the open position to dose fluid. The base opening time may also be denoted as a base pulse width. The base opening time may, for example, be for example be taken from a table or calculated from a function. The table or function, respectively, is in particular fix for a specific injector type and does not take into account the injector-specific calibration value.

Dependent on the calibration value and the base quantity, e.g. the fluid volume or the base opening time length, a set-point opening time length is determined. The set-point opening time length may also be denoted as an injector-specific pulse-width.

The valve needle of the injector is controlled to be in the open position correlated to the set-point opening time length. In particular, the actuator assembly is energized by a current signal or a voltage signal having the injector-specific pulse-width for dispensing the fluid volume.

In this context, the preload force is the force that is exerted by the spring element on the valve needle in the closed position of the valve needle. The spring element is acting to urge the valve needle in the closed position by the preload force. The spring element is in particular operable to retain the valve needle in the closed position by means of the preload force when the actuator assembly is not energized. For example, when no other forces act on the valve needle, such as an actuator force or a force by a pressure of a fluid, the preload force has the effect that the valve needle is in the closed position.

The preload force is, for example, adjusted during the manufacturing process of the injector. The injector is, for example, adjusted for a given injection volume in a given set-point at a given pressure of the fluid for a given opening time length of the injector. In particular, adjusting the injector may comprise operating the injector at a predetermined fluid pressure for a predetermined opening time length and changing the preload force until the injector dispenses a predetermined fluid volume.

In the closed position of the valve needle, the valve needle for example sealingly rests on the valve seat, by this preventing fluid flow through at least one injection nozzle. In the open position the valve needle enables a fluid flow through the injection nozzle, for example through a fluid outlet portion.

Because the preload force of an injector normally is adjusted for a given set-point, in particular for a comparatively large fluid volume and/or opening time length per injection event, the dispersion of an injection volume from one injector to another can be high for an operation of the injectors at another set-point of the fluid volume or the opening time length, respectively. By adapting the opening time length dependent on the preload force so that the injector is not necessarily operated during the base opening time length—which is independent of the injector-specific calibration value—but for the injector-specific set-point opening time length—which takes into account the injector-specific calibration value—, the dispersion of the injection volume can be reduced and a very exact injection volume can be achieved. In particular, the dependency of the injection volume of the injector-specific preload is particularly small.

According to one embodiment, the set-point opening time length is determined in such a manner that if the base quantity is smaller than a predetermined value, then the set-point opening time length is longer, the higher the preload force is. The predetermined value is preferably the value of the base quantity for which the injector has been adjusted with regard to the preload force during manufacture of the injector.

For example, the set-point opening time length is determined in such a manner that if the base opening time length is shorter than an adjustment opening time length for which the injector was adjusted with regards to the preload force, then the set-point opening time length is shorter, the higher the preload force is, which is represented by the calibration value. In other words, the set-point opening time length may be determined by means of subtracting a pulse-width offset value from the base opening time length, the pulse-width offset value being in particular directly proportional to the preload force. The pulse-width offset value may in particular only be taken into account when the base opening time length is shorter than the adjustment opening time length.

Hereby, a very low dispersion of the injection volume from one injector to the other can be achieved for a short opening time length of the injectors, because especially for opening time lengths, which are shorter than the opening time length for which the injector was adjusted, the dispersion of the injection volume is possibly very high.

According to a further embodiment, the calibration value is provided by a coding of the injector. The predetermined value of the base quantity, for example the adjustment opening time length, may also be included in the coding of the injector. The coding can for example be imported into a control unit during the manufacturing of the combustion engine. According to a further embodiment, the coding is a barcode, for example a linear barcode or a two-dimensional barcode such as a QR code. Hereby the coding can be easily read.

In one embodiment, the method comprises controlling a further injector in addition to the injector, providing the same base quantity—e.g. the same base opening time length—for the injector and the further injector, providing the calibration value for the injector and a further calibration value for the further injector. The calibration value is representative for the preload force of the injector while the further calibration value is representative for the preload force of the further injector.

In this embodiment, the method further comprises determining the set-point opening time length for the injector in dependence from the calibration value and the base quantity and a further set-point opening time length for the further injector in dependence from the further calibration value and the base quantity. Unless the preload forces of the injector and the further injector are identical, the set-point opening time length is in particular different from the further set-point opening time length, at least when the base opening time length is shorter than the adjustment opening time length, for dispensing the same injection volume.

The injector is operated by means of energizing its actuator assembly for the set-point time length for dispensing the injection volume and the further injector is operated by means of energizing its actuator assembly for the further set-point time length for dispensing the injection volume.

In this way, a difference of the fuel quantity which is injected into the individual cylinders may be particularly small. Thus, the risk of having an unintentionally weak air/fuel mixture—which may lead to bad engine performance—or an unintentionally rich air/fuel mixture—which may lead to high gas emissions—in one cylinder is particularly small.

FIG. 1 shows an injector 1 that is particular suitable for dosing fuel to an internal combustion engine. The injector 1 comprises a central longitudinal axis LA and an injection valve housing HO with an injection valve cavity CA. The injection valve cavity CA takes in a valve needle VN being axially movable within the injection valve cavity CA. The injector 1 further comprises a valve seat VS, on which the valve needle VN rests in a closed position and from which the valve needle VN is lifted for an open position. The injector 1 further comprises a spring element SE being designed and arranged to exert a preload force PF on the valve needle VN acting to urge the valve needle VN in the closed position. The injector 1 further comprises an inlet tube IT in which a calibration tube CO is arranged. The calibration tube CO forms a seat for the spring element SE. During the manufacturing process of the injector 1, the calibration tube CO can be axially moved with respect to the inlet tube IT in order to adjust the preload force PF in a desired manner. During operation of the injector 1, the calibration tube CO is positionally fix with respect to the inlet tube IT and the valve housing HO, e.g. due to a friction fit with the inlet tube IT, the valve housing HO, or another constituent part of the injector 1 which is positionally fix with respect to the inlet tube IT or the valve housing HO, respectively. Thus the spring element SE exerts the preload force PF on the valve needle VN of the injector 1.

The preload force PF is hereby the force that is exerted by the spring element SE in the closed position of the valve needle VN. The preload force PF is for example adjusted so that the injector 1 produces a given injection volume in a given set-point at a given pressure of a fluid for a given opening time length of the injector 1. For example the injector 1 is adjusted at an adjustment opening time length of 0.6 ms and a given fuel pressure of 200 bar to dispense a fuel volume corresponding to 6 mg of gasoline.

In the closed position of the valve needle VN, the valve needle VN sealingly rests on the valve seat VS, by this preventing fluid flow through at least one injection nozzle. The injection nozzle may be, for example, an injector hole. However, it may also be of some other type suitable for dosing fluid.

The injector 1 is provided with an actuator assembly that is preferably an electromagnetic actuator. The electromagnetic actuator assembly comprises a coil CL which is preferably arranged inside the injection valve housing HO and is overmolded.

In the following the function of the injector 1 is described in detail:

Fluid as for example gasoline or diesel is led from a fluid inlet portion of the injector 1 towards a fluid outlet portion of the injector 1.

The valve needle VN prevents a fluid flow through the fluid outlet portion in the injection valve cavity CA in the closed position. Outside of the closed position of the valve needle VN, the valve needle VN enables the fluid flow through the fluid outlet portion, therefore it is in the open position.

In case that the electromagnetic actuator assembly with the coil CL gets energized, the coil may generate an electromagnetic force acting on an armature part which may be operable to displace the valve needle VN away from the closed position. For example, the armature part is fixedly coupled with the valve needle VN. Therefore, the valve needle VN may move in axial direction away from the fluid outlet portion, in particular upstream of a fluid flow, due to the electromagnetic force acting on the armature part, such that the valve needle VN moves in axial direction out of the closed position. Outside of the closed position of the valve needle VN a gap between the valve housing HO and the valve needle VN at an axial end of the valve needle VN facing away from the actuator assembly forms a fluid path and fluid can pass through the injection nozzle.

In case the actuator unit is de-energized, the spring element SE may force the valve needle VN to move in axial direction in its closed position.

It depends on the force balance including the force on the valve needle VN caused by the actuator assembly with the coil CL and the preload force PF on the valve needle VN caused by the spring element SE whether the valve needle VN is in its closed position or not.

Figure 2:
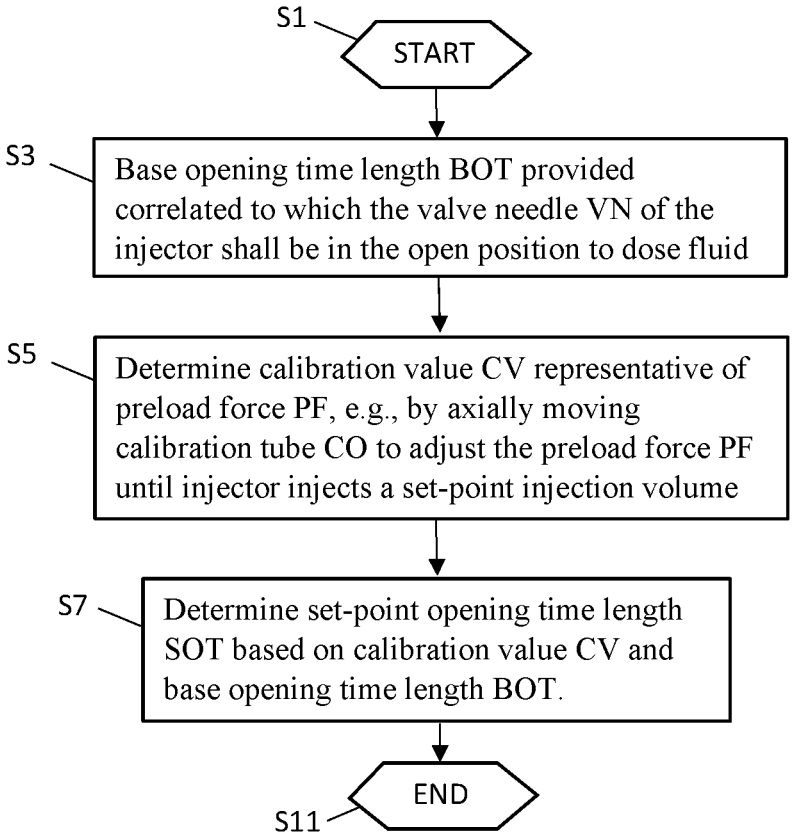

FIG. 2 shows a flow chart of a method for controlling the injector 1. The method can for example be executed in an engine control unit, which also can be described as device for controlling an injector of a combustion engine. The engine control unit may comprise a program, i.e. a set of computer readable instructions, which are operable to perform the method when executed by the engine control unit.

The method starts in an optional step S1, in which, for example, variables can be initialized.

In a step S3 a base opening time length BOT is provided correlated to which the valve needle VN of the injector 1 shall be in the open position to dose fluid.

In a step S5 a calibration value CV is provided which is representative for the preload force PF, for example the calibration value CV is the value of the preload force PF. The calibration value CV is for example saved in a memory of the control unit. It is for example imported into the control unit during the manufacturing of the combustion engine by means of interpreting a coding of the injector 1. Interpreting the coding may, for example, involve reading a bar code provided on the injector, the calibration value being coded in the bar code.

In a step S7 dependent on the calibration value CV and the base opening time length BOT a set-point opening time length SOT is determined.

Figure 3:
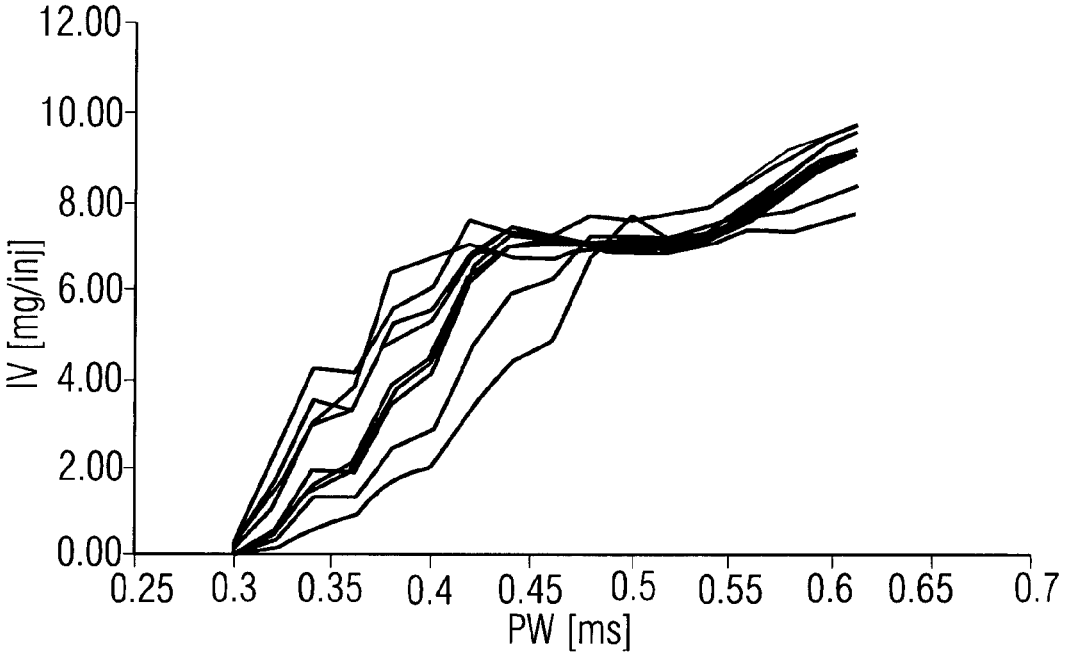

FIG. 3 shows, for several individual injectors of the same type, the dependency of the injection volume IV—per injection event and injector in mg—on the pulse width PW—in ms. The pulse width PW is in particular the activation time length of the actuator assembly of the respective injector 1 for one injection event. It is correlated to the opening time length of the injector 1.

As can be seen in FIG. 3, if injectors 1 with different preload forces PF are used at a set-point different to the set-point for which they were adjusted at the manufacturing, the injection volume IV of one injection event can have a high variation from injector to injector when each of the injectors is operated with the same opening time length. The variation is dependent of a pulse width PW which is for example correlated with an opening time length. For example at a pulse width PW of 0.4 ms, the flow variation between the different injectors is approx. 5 mg, whereas at a pulse width PW of 0.6 ms, the flow variation is only 2 mg.

Figure 4:
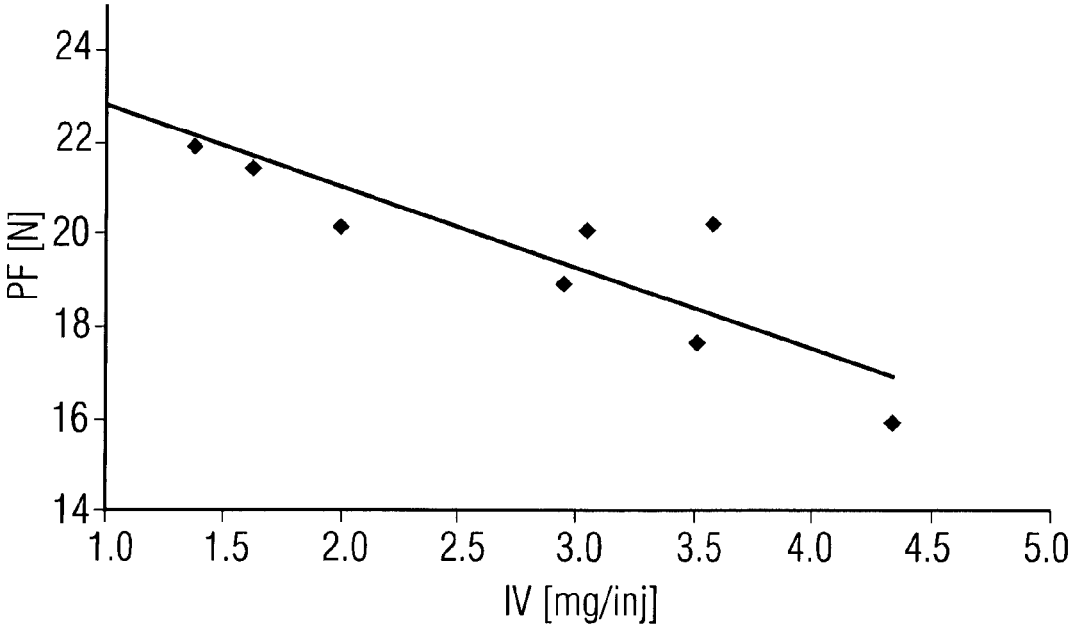

FIG. 4 shows, for each of the injectors of FIG. 3, the injection volume IV per injection event per injector in mg (horizontal axis) in dependence on the preload force PF in N of the respective injector (vertical axis) for a fuel pressure of 200 bar and a pulse width PW of 0.34 ms. That pulse width is considerably shorter than the adjustment pulse width of, for example, 0.6 ms. As can be seen by the straight line in FIG. 4, the preload force PF of the injectors has a direct correlation with the injection volume IV generated by the respective injector. In particular, it is inversely proportional to the injection volume IV.

Therefore, according to the method of the present disclosure, a set-point opening time length SOT is determined individually for each injector, for example as explained in the following.

Figure 5:
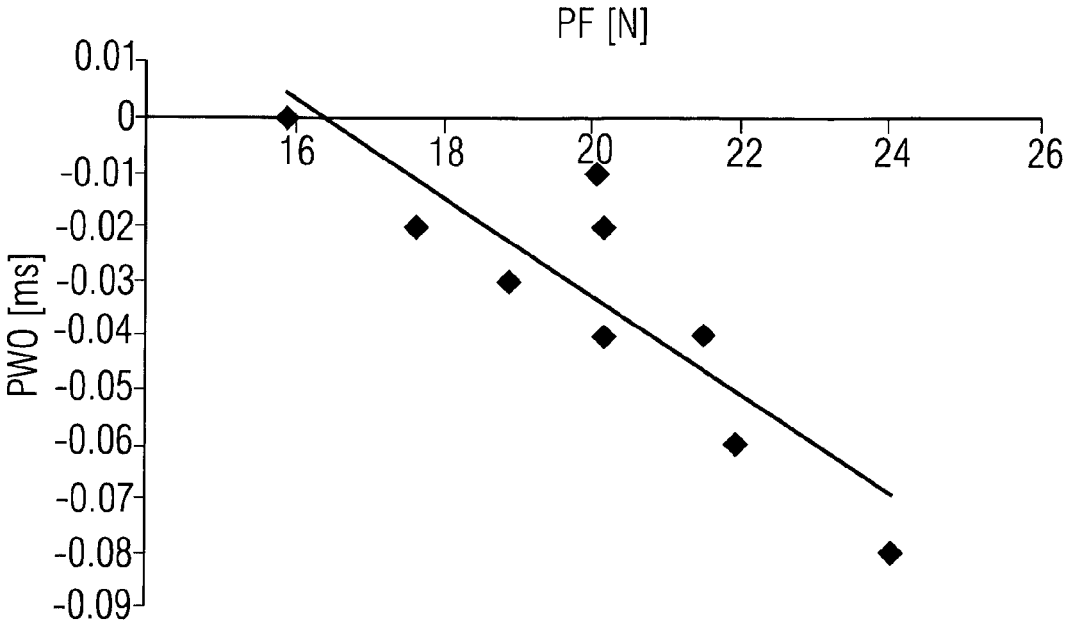

FIG. 5, shows an exemplary embodiment for determining the set-point opening time SOT in dependence on the preload force PW as the calibration value CV. Specifically, an offset of the pulse width PWO, or a corresponding offset of the opening time length is determined here, dependent on the preload force PF. In the present embodiment, a linear relationship between the pulse width offset PWO and the preload force PF is used as represented by the straight line in FIG. 4. The set-point opening time length SOT is then for example the base opening time length BOT minus the value of the offset of the pulse width PWO or the correlated offset of the opening time length. Since the pulse width offset PWO has a negative value, the set-point opening time length SOT is longer than the bas opening time length BOT.

In a step S9 the valve needle VN of the injector 1 is controlled to be in the open position correlated to the set-point opening time length SOT, for example by energizing the electromagnetic actuator assembly.

Figure 6:
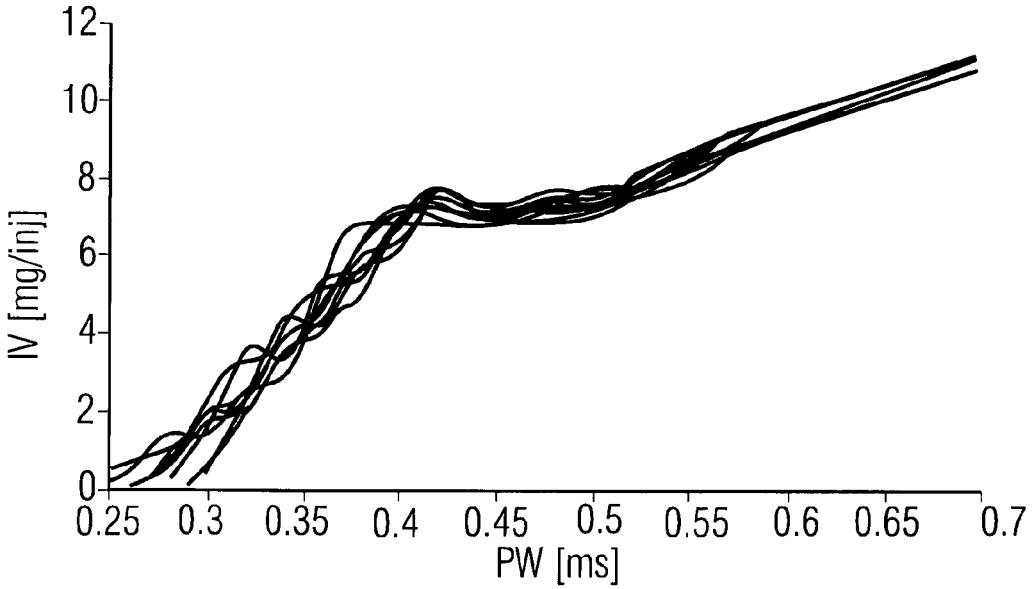

FIG. 6, analogously to FIG. 3, shows the injection volume IV in dependence on the pulse width PW for the injectors of FIG. 3. However, the pulse width PW of the individual injectors is corrected by the pulse width offset PWO according to the linear relationship of FIG. 4 individually for each injector in the chart of FIG. 6. Thus, each injector 1 is operated with a set-point opening time SOT depending on the individual preload force PF of the respective injector 1. This leads to a much lower dispersion of the injection volume IV of one injection pulse between the individual injectors 1, as can be seen in FIG. 6 in comparison to FIG. 3.

In an optional step S11 the method is stopped and can be started again in step S1.

What is claimed is:

1. A method for controlling an injector of a combustion engine, wherein the injector comprises an injection valve housing with an injection valve cavity, a valve needle axially movable with the injection valve cavity, a valve seat on which the valve needle rests in a closed position and from which the valve needle is lifted for an open position, a spring element positioned between a calibration tube and the valve needle, the spring element exerting a preload force on the valve needle acting to urge the valve needle in the closed position, an actuator assembly configured to displace the valve needle away from the closed position, the method comprising:

during manufacturing of the injector:

operating the injector at a predetermined fluid pressure for a predetermined opening time length and changing the spring preload force by adjusting an axial position of the calibration tube until the injector dispenses a predetermined fluid volume at the predetermined fluid pressure and predetermined opening time length, fixing the calibration tube in the adjusted axial position, and determining an injector-specific spring preload force calibration value representing the spring preload force defined by the fixed position of the calibration tube, during normal operation of the combustion engine, performing an operational injection by:

determining a base opening time for the operational injection as a function of a fluid volume to be dispensed by the injector for the operational injection, wherein the fluid volume to be injected for the operational injection is different than the predetermined fluid volume, determining a pulse width offset as a function of (a) the fluid volume to be injected for the operational injection and (b) the spring preload force calibration value of the injector, determining a set-point opening time length for injecting the base quantity of fluid based on (a) the base opening time for the operational injection and (b) the determined pulse width offset, such that the set-point opening time length is determined as a function of the spring preload force of the injector, and controlling the valve needle of the injector to be in the open position by energizing the actuator assembly with a current signal or a voltage signal based on the determined set-point opening time length.

2. The method of claim 1, wherein the base opening time is a base opening time length for which the injector would be controlled to be in the open position for dosing fluid without accounting for the calibration value.

3. The method of claim 2, wherein the set-point opening time length is determined such that if the base opening time length is shorter than an adjustment opening time length, for which the injector has been adjusted with regards to the preload force, then the set-point opening time length is increased as a function of the preload force via the calibration value.

4. The method of claim 1, wherein the calibration value is provided by a coding of the injector.

5. The method of claim 4, wherein the coding is a barcode.

6. The method of claim 1, further comprising controlling a further injector in addition to the injector, wherein the injector and the further injector each comprise an actuator assembly, wherein controlling the further injector comprises:

providing a further spring preload force calibration value for the further injector which represents a spring preload force of the further injector defined by a fixed position of a calibration tube of the further injector, the further spring preload force calibration value of the further injector being different than the spring preload force calibration value of the injector, determining a further set-point opening time length for the further injector as a function of the further spring preload force calibration value for the further injector and the base opening time, the further set-point opening time length being different than the set-point opening time length based on the further spring preload force calibration value of the further injector being different than the spring preload force calibration value of the injector, operating the injector by energizing the actuator assembly of the injector for the set-point time length, and operating the further injector by energizing the actuator assembly of the further injector for the further set-point time length.

7. A control device for controlling a plurality of injectors of a combustion engine, wherein each injector comprises an injection valve housing with an injection valve cavity, a valve needle axially movable with the injection valve cavity, a valve seat on which the valve needle rests in a closed position and from which the valve needle is lifted for an open position, a spring element positioned between (a) a calibration tube fixed in an axial position during manufacturing and (b) the valve needle, wherein the fixed axial position of the calibration tube defines an injector-specific spring preload force exerted by the spring element on the valve needle acting to urge the valve needle in the closed position, an actuator assembly configured to displace the valve needle away from the closed position, wherein different ones of the plurality of injectors have different injector-specific spring preload forces based on different fixed axial positions of the calibration tubes of the respective injectors, the control device comprising:

a processor; and computer instructions stored in non-transitory computer-readable media and executable by the processor to determine an injector-specific set-point opening time for injections by different ones of the plurality of injectors, wherein determining the injector-specific set-point opening time for a respective injection by a respective injector comprises:

determining an injector-specific spring preload force calibration value for the respective injector representing the injector-specific spring preload force defined by the fixed axial position of the calibration tube of the respective injector, determining a base opening time as a function of a fluid volume to be dispensed by the respective injector for the respective injection, determining a pulse width offset for the respective injection as a function of the injector-specific spring preload force calibration value of the respective injector, determining a set-point opening time length for the respective injection based on (a) the base opening time and (b) the determined pulse width offset, and controlling the valve needle of the respective injector to be in the open position by energizing the actuator assembly with a current signal or a voltage signal based on the determined set-point opening time length, wherein different pulse width offsets are determined for injections of the same fluid volume by different ones of the plurality of injectors based on the determination of each pulse width offset as a function of the injector-specific spring preload force calibration value of the respective injector performing each respective injection.

8. The control device of claim 7, wherein the base opening time is a base opening time length for which the injector would be controlled to be in the open position for dosing fluid without accounting for the calibration value.

9. The control device of claim 8, wherein the set-point opening time length is determined such that if the base opening time length is shorter than an adjustment opening time length, for which the injector has been adjusted with regards to the preload force, then the set-point opening time length is increased as a function of the preload force via the calibration value.

10. The control device of claim 7, wherein the calibration value is provided by a coding of the injector.

11. The control device of claim 10, wherein the coding is a barcode.

* * * * *